United States Patent [19]

Schmidt

[11] Patent Number: 4,901,557

[45] Date of Patent: Feb. 20, 1990

[54] METHOD AND APPARATUS FOR THE PRODUCTION OF FRUSTO-PYRAMIDAL CAN BODIES

[75] Inventor: Herwig Schmidt, Hamburg, Fed. Rep. of Germany

[73] Assignee: Elpatronic AG, Zug, Switzerland

[21] Appl. No.: 205,203

[22] Filed: Jun. 10, 1988

[30] Foreign Application Priority Data

Jul. 7, 1988 [CH] Switzerland ..... 02571/87

[51] Int. Cl.[4] ..... B21D 51/26

[52] U.S. Cl. ..... 72/370; 72/393

[58] Field of Search ..... 413/69, 73, 75, 76; 72/355, 370, 393

[56] References Cited

U.S. PATENT DOCUMENTS 3,350,914 11/1967 Ohlsson ..... 72/393
3,690,141 9/1972 Brownbill ..... 72/393
4,271,777 6/1981 Collins et al. ..... 413/76

FOREIGN PATENT DOCUMENTS 144534 8/1984 Japan ..... 413/69

*Primary Examiner*—Lowell A. Larson
*Attorney, Agent, or Firm*—McCormick, Paulding & Huber

[57] ABSTRACT

Circular cylindrical bodies (2) are formed from rectangular sheet-metal blanks by rounding and longitudinal seam welding. These are widened oval-conically over their whole length in a first expanding operation and then relaxed again. Then the bodies (2) are widened in a second expanding operation so that they acquire their polygon-like, particularly rectangle-like, cross-sectional shape over their whole length. As a result, the bodies are stressed at their marginal regions at the ends in such a manner that these marginal regions do not become undulatory and can therefore be satisfactorily joined with a can cover or bottom.

16 Claims, 4 Drawing Sheets

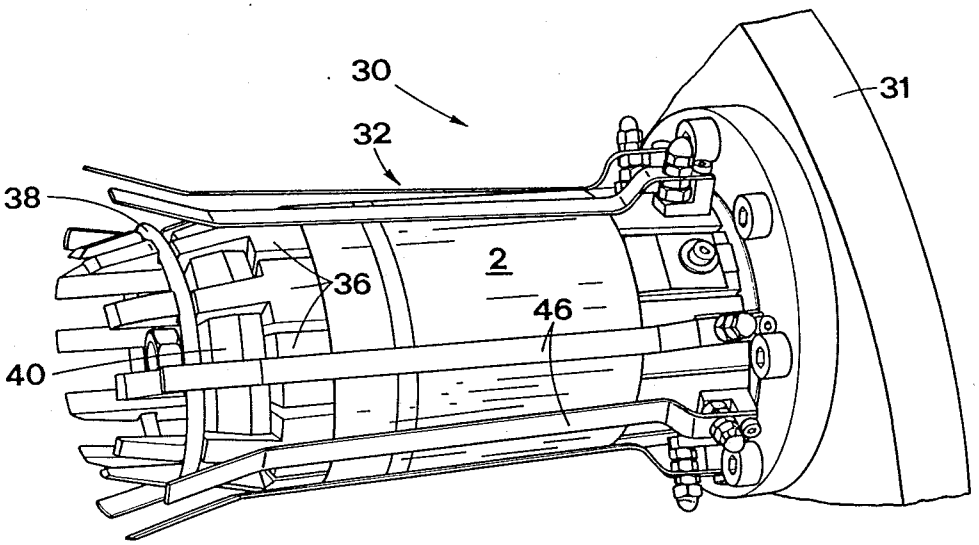
Fig.4
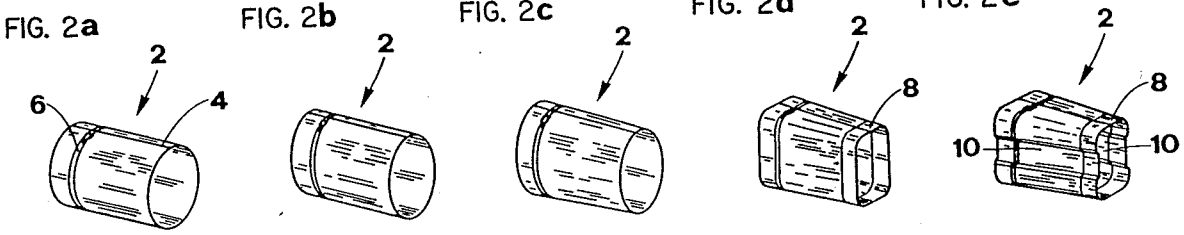
FIG. 2e
FIG. 2d
FIG. 2c
FIG. 2b
FIG. 2a

METHOD AND APPARATUS FOR THE PRODUCTION OF FRUSTO-PYRAMIDAL CAN BODIES

The invention relates to a method of producing frusto-pyramidal can bodies wherein plane sheet-metal blanks are rounded, two longitudinal edges of the sheet-metal blanks are welded together and the round cross-sectional shape of the bodies thus formed is converted by expansion into a polygon-like, particularly a rectangle-like, cross-sectional shape.

In such a method, it is known to start from sheet-metal blanks in the form of sectors of a circular ring and to round these so that when their longitudinal edges are welded, frusto-conical bodies result which are then widened out in one step into a rectangle-like cross-sectional shape. A great deal of waste occurs during the production of the sheet-metal blanks in the form of sectors of circular rings and during the widening out there is the danger that the edge which bounds the smaller of the two ends of the body may arch as a result of an excess of sheet metal accruing there and making the tight beading on of a cover more difficult as a result.

It is therefore the object of the invention to develop further a method of the kind described in such a manner that can bodies having end edges well suited to the beading on of a cover or a bottom result, with a reduced expenditure of material.

According to the invention, the problem is solved in that circular cylindrical bodies are formed from rectangular sheet-metal blanks by rounding and longitudinal seam welding, in a first expanding operation, the bodies are widened oval-conically over their whole length and then relaxed again in a second expanding operation, the bodies are then widened so that they acquire their polygon-like, particularly rectangle-like, cross-sectional shape over their whole length.

Thus according to the invention, each individual body is widened in two successive steps. As a result, the body is stressed, particularly in its marginal regions adjacent to each end, in such a manner that these marginal regions do not become undulatory but have the prescribed plane, rounded rectangular shape very accurately. In this manner, particularly favourable prerequisites are afforded for a reliably tight fitting of a cover and a bottom to each body.

It is an advantage if the bodies are pressed flat in a preparatory operation before the first expanding operation, as a result of which they acquire an oval-cylindrical shape.

This preparatory operation may appropriately be carried out in such a manner that when the body is being pressed flat, its longitudinal seam is laid in one of two zones of greatest curvature situated diametrically opposite one another and these zones are each converted, by the following deformation, into a narrower side of the finished body.

It is a particular advantage if, during the second expanding operation, the bodies are widened over the predominant part of their length so that they assume a frusto-pyramidal shape becoming narrower from their larger end and are at least resiliently distended, preferably slightly permanently widened in the opposite direction in a marginal region adjacent to their smaller end so that there their former frustroconical shape at least approaches a prismatic shape.

If the second expanding operation includes these different actions on the marginal region adjoining the smaller end of the body on the one hand and the whole of the rest of the body on the other hand, the security against unwanted deformation of the marginal regions of the bodies is particularly great.

The invention further relates to apparatus for carrying out the method according to the invention, with a longitudinal conveyor.

In one such apparatus, one of two lateral conveyor belts converging in the direction of movement of the longitudinal conveyor is disposed at each side of the central plane of the longitudinal conveyor for pressing the circular cylindrical bodies flat.

Independently of this or in addition thereto, an apparatus for carrying out the method according to the invention may be formed in such a manner that disposed following on the longitudinal conveyor is a first transverse conveyor which is movable step by step and carries at least one first expanding mandrel, the first expanding mandrel can be expanded out of an oval cylindrical shape for receiving one of the bodies in an oval conical shape to widen the body, associated with the first transverse conveyor is a second transverse conveyor which is likewise movable step-by-step and carries at least one second expanding mandrel and the second expanding mandrel can be expanded in a pyramidal shape.

This apparatus may appropriately be further developed in that the two transverse conveyors are arranged situated opposite one another in such a manner that, in a transfer station, a first expanding mandrel is in alignment with a second expanding mandrel, in the expanded state, these two expanding mandrels become narrower in the same direction and a transfer conveyor is disposed between the two transverse conveyors to transfer one body at a time from the first expanding mandrel to the second expanding mandrel in alignment therewith.

This further development has the advantage that each individual body only has to cover a short straight path from the first expanding mandrel, which has widened it oval-conically, to the second expanding mandrel which will widen it substantially pyramidally, so that the transfer conveyor can be simple in design.

Various known conveyors are suitable as transverse conveyors such as swivel arms, for example, which can be swivelled backwards and forwards between the transfer station and a further station. Endless conveyors are better suited for the production of large numbers of bodies per unit of time, however. For example, the first and the second transverse conveyors may each be formed by a chain conveyor. What is primarily of importance is that a first expanding mandrel is always available when a body which has been pressed flat is brought up by the longitudinal conveyor and that a second expanding mandrel is always available when a first expanding mandrel has reached the transfer station with a body widened oval-conically.

A development according to the invention is particularly advantageous wherein the two transverse conveyors each comprise a rotary table with a plurality of expanding mandrels and the axes of the two rotary tables are arranged with spacing from one another, parallel to the longitudinal conveyor.

In this case, it is further an advantage if the two transverse conveyors each comprise an upright on which the associated rotary table is mounted with its expanding mandrels remote from the upright and at least one ram is supported on each upright for the actuation of the expanding mandrels disposed on the associated rotary table.

Each of the second expanding mandrels preferably comprises, in the expanded state, a pyramidal main portion and a prismatic auxiliary portion. In this case, the main portion is associated with the main portion of the can bodies while the auxiliary portion is allocated to the marginal region at the smaller end of the can bodies.

It is further advantageous if each of the second expanding mandrels can be locked in its expanded position so that it is able to hold one body at a time, which has been widened into a substantially frusto-pyramidal shape, gripped for a stamping treatment.

As a result of the last-mentioned feature, the apparatus according to the invention can be further developed in that a stamping tool is associated with the second transverse conveyor to impress recesses in opposite sides of the bodies. As a result of the impression of recesses having a more or less large area in the bodies still held gripped, each on a second expanding mandrel, it is possible to prevent, with additional certainty, buckling stresses being released which might deform the edges of the bodies when these are released.

One example of embodiment of the invention is explained with further details below with reference to diagrammatic drawings.

FIG. 1 shows an oblique view of an apparatus for the production of pyramidal can bodies, FIG. 2*a* shows a can body in a circular, cylindrical initial state.

FIG. 2*b* shows the can body of FIG. 2*a* in a subsequent oval-cylindrical shape.

FIG. 2*c* shows the can body of FIG. 2*b* in a subsequent oval-conical shape.

FIG. 2*d* shows the can body of FIG. 2*c* having a pyramid-like main portion and a prism-like marginal region.

FIG. 2*e* shows the can body of FIG. 2*d* with a recess extending longitudinally down each of the two broadest lateral faces.

FIG. 4 shows an oblique view in the direction of the arrow IV in FIG. 3.

Figure 1:
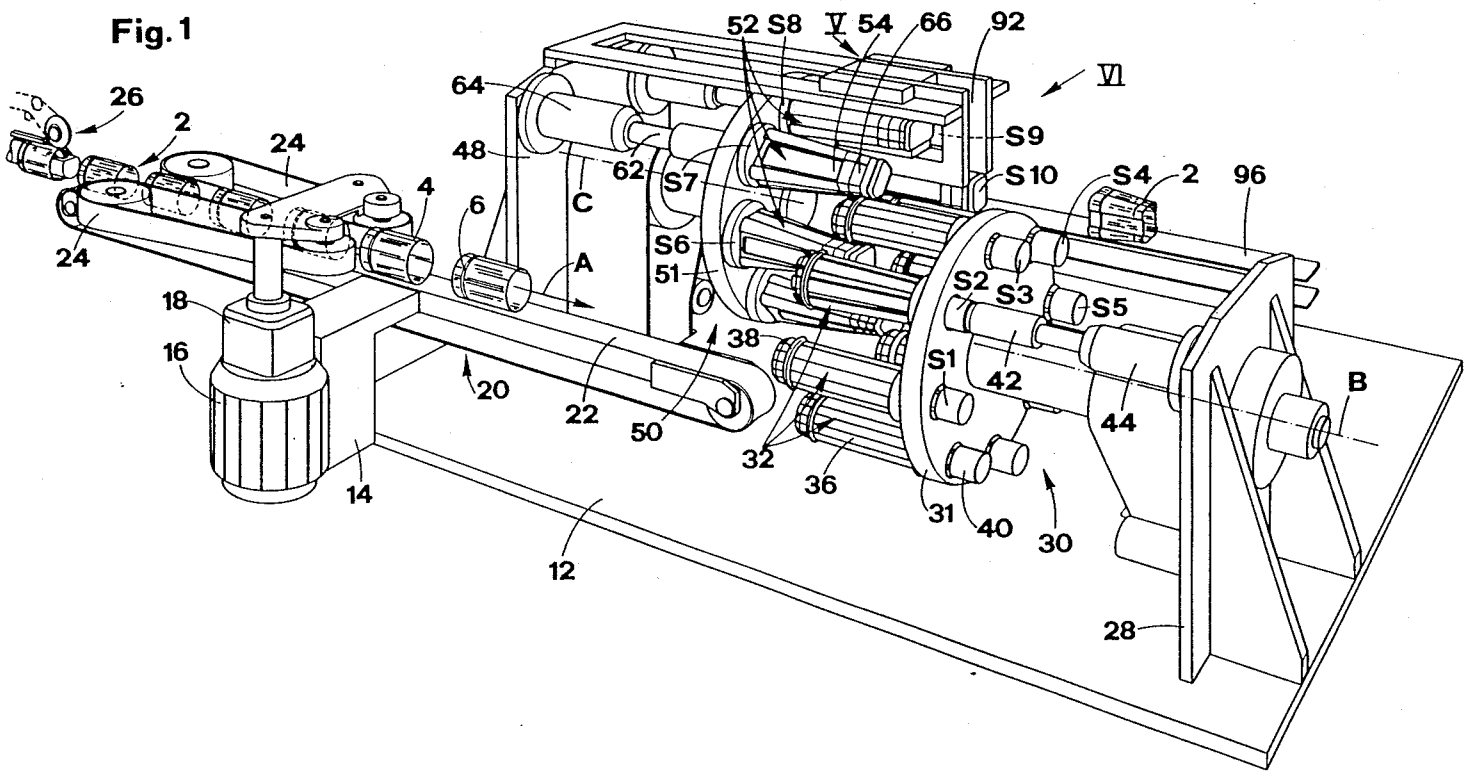
Figure 3:
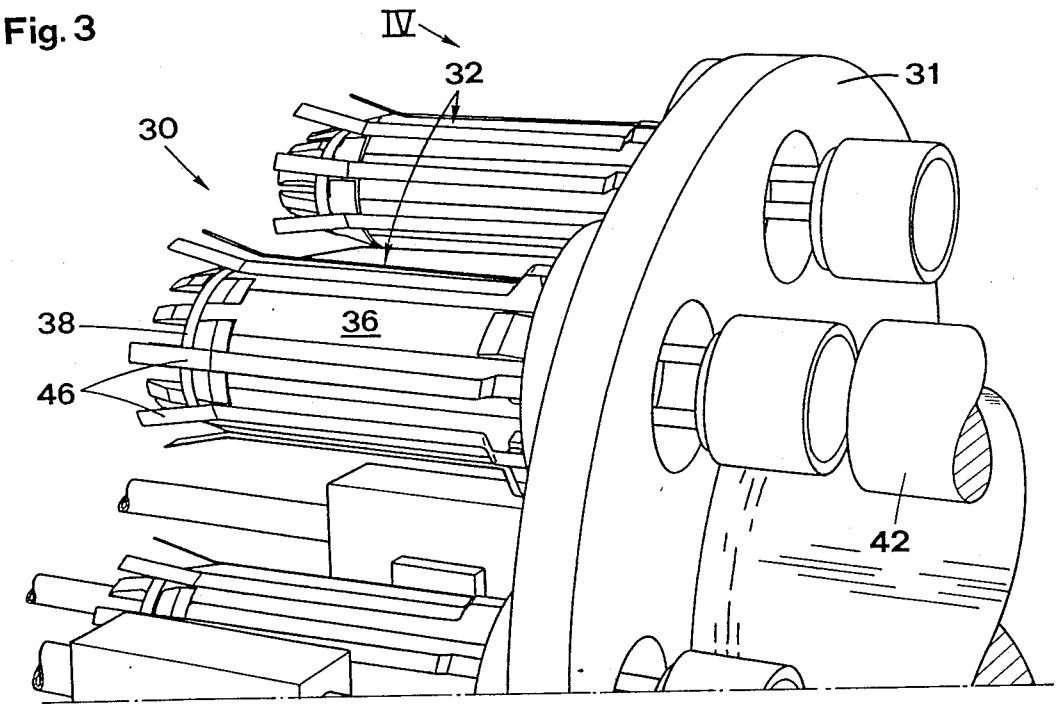
FIG. 3 shows an enlarged detail from FIG. 1.
Figure 5:
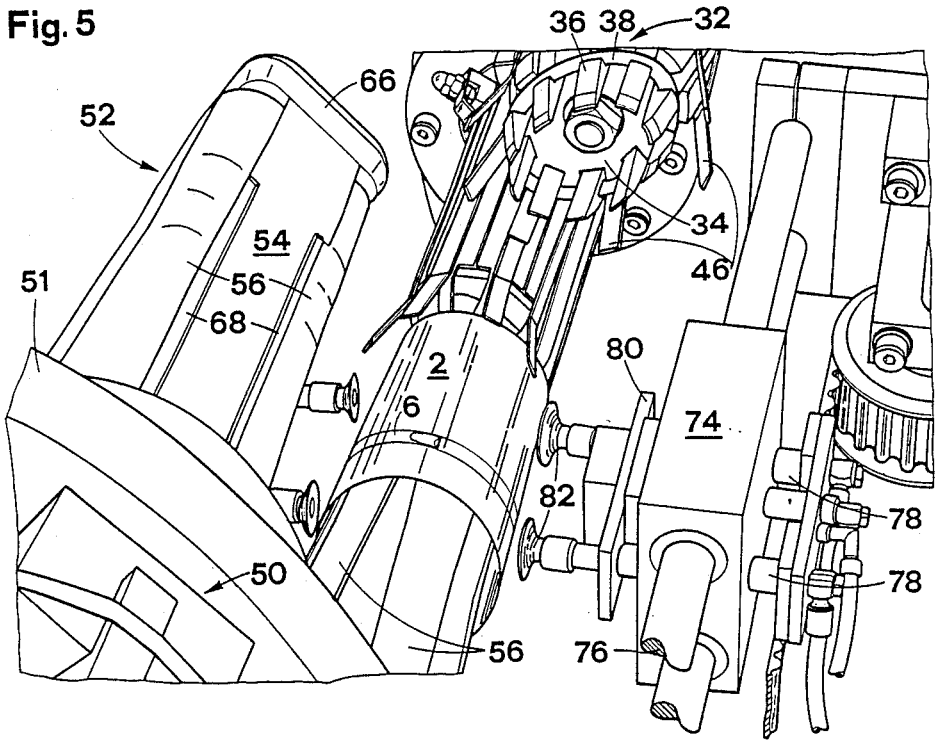
FIG. 5 shows an oblique view in the direction of the arrow V in FIG. 1
Figure 6:
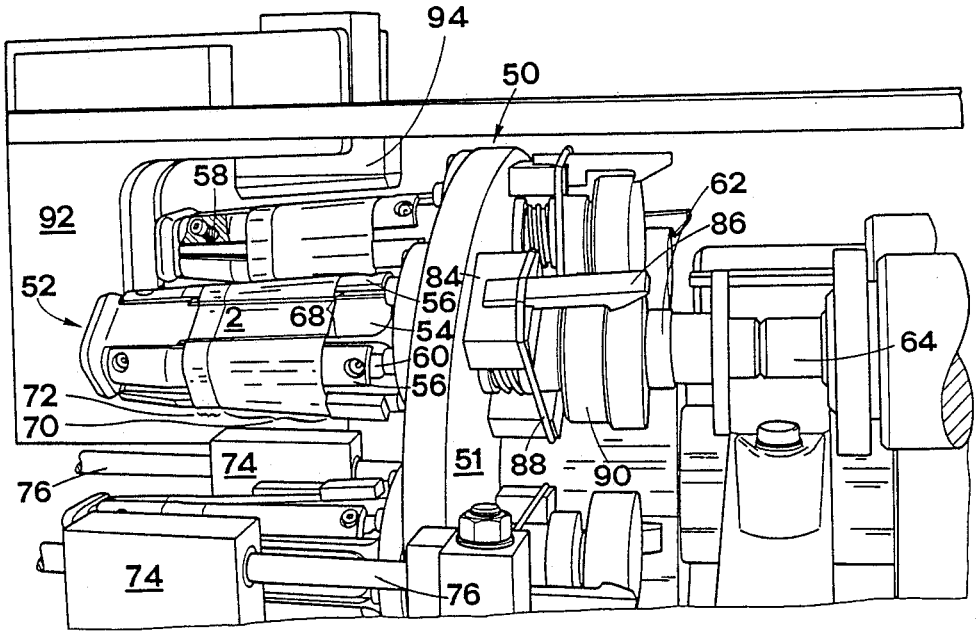
FIG. 6 shows an oblique view in the direction of the arrow VI in FIG. 1.

The apparatus illustrated serves the purpose of further processing of bodies 2 for preserving cans or the like which are supplied to it in a circular cylindrical initial state, designated by a in FIG. 2, from a body welding machine of conventional construction and each of which comprises a longitudinal seam 4 and, close to one of its ends, a tear-off strip 6 which is closed on itself in the form of a ring. The apparatus shapes the bodies 2 step-by-step, as can be seen from FIG. 2, namely starting from the circular cylindrical shape a into an oval cylindrical shape b, then into an oval conical shape c, and next into a shape d with a pyramid-like main portion and a prism-like marginal region 8.

The pyramid-like main portion of the body 2 has the cross-sectional shape of a rounded rectangle in the shaping state d; its large base is at the end which is adjacent to the tear-off strip 6 while the small end of the pyramid-like main portion lies at the transition into the prism-like marginal region 8. From there on as far as the end remote from the tear-off strip 6, the body 2 has a constant rounded rectangular cross-section.

Finally, the body 2 is given the shape e which differs from the shape d only in that the two broader of the four lateral faces each have a recess 10 directed longitudinally. The longitudinal seam 4 lies in the middle of one of the two narrower lateral faces of the body 2.

The apparatus which effects the described shaping of the bodies 2 has a machine frame 12 with a bracket 14 which carries an electric motor 16 and a gear unit 18 to drive a longitudinal conveyor 20. In the example illustrated, the longitudinal conveyor 20 has a conveyor belt 22 which conveys the bodies 2 at short intervals one behind the other in the direction of the arrow A in FIG. 1. Also driven from the electric motor 16 via the gear unit 18 is a pair of lateral conveyor belts 24 which converge in the conveying direction in such a manner that they gradually press the bodies 2, which leave a welding station 26 in the circular cylindrical state a, into the oval cylindrical shape b. In the course of this, the longitudinal seam 4 lies in a longitudinal central plane between the two lateral conveyor belts 24, in which the zones of greatest curvature of the oval cylindrically shaped bodies 2 lie. In order that the bodies 2 should not be able to turn on the conveyor belt 22, this is magnetized or is guided on a magnetic rail.

Secured to the machine frame 12, on the right in FIG. 1, is a first upright 28 which belongs to a first transverse conveyor 30. A first rotary table 31 is mounted on the upright 28 for rotation about a horizontal axis B parallel to the longitudinal conveyor 20. Eight expanding mandrels 32, parallel to the axis B, are secured to the rotary table 31 with uniform spacing. The rotary table 31 can be driven in rotation step-by-step, through 45° each time, that is to say through the angular spacing between each two adjacent expanding mandrels 32, from a drive not illustrated.

Each of the expanding mandrels 32 has a supporting member 34 which is secured to the rotary table 31 and on which a ring of segmental bars 36 is mounted. Each of the segmental bars 36 is pivotable about an axis which is tangent to a circle round the axis of the expanding mandrel 32 in question. In a position of rest, the assembly of segmental bars 36 of each expanding mandrel 32 forms a substantially oval cylindrical body on which one of the can bodies 2 of oval cylindrical shape b can easily be pushed. A spring 38, which extends all round the segmental bars 36, tends to maintain their position of rest.

By means of a wedge 40, the segmental bars 36 can be spread apart, against the resistance of the spring 38, in such a manner that a body 2 placed thereon is widened out of its oval cylindrical shape b into the oval conical shape c, the greatest widening taking place in the region of the end which is adjacent to the tear-off strip 6 and remote from the rotary table 31. A ram 42, which can be reciprocated in the direction of the axis B by a piston-cylinder unit 44 supported on the upright 28, is provided for the actuation of the wedge 40.

In order that the bodies 2 should not be uncontrolled, after they have each received their oval conical shape c on one of the expanding mandrels 32, each of the expanding mandrels 32 is surrounded by a ring of guide bars 46. When the ram 42 has been pulled back into its position of rest, to the right in FIG. 1, and the segmental bars 36 have likewise been restored to their initial position by the spring 38, the body 2, widened on the expanding mandrel 32 in question, remains held in the guide bars 46 in such a manner that its axis continues to coincide with the axis of the expanding mandrel 32.

Secured to the machine frame 12, with spacing from the first upright 28, further to the left in FIG. 1, is a second upright 48 which belongs to a second transverse conveyor 50. A second rotary table 51 is mounted on the second upright 48 for rotation about a horizontal axis C parallel to the axis B and spaced apart therefrom. Eight expanding mandrels 52 are secured to the second rotary table 51, parallel to the axis C and at equal angular distances of 45°. The second rotary table 51 can be rotated step-by-step through 45° each time, in synchronism with the first rotary table 31 and is adjusted in such a manner that after each step, an expanding mandrel 32 is in alignment with an expanding mandrel 52.

Each of the expanding mandrels 52 has a supporting member 54 which is secured to the rotary table 51 and on which four segmental bars 56 are mounted for displacement and held together by springs 58. The segmental bars 56 can be spread apart by means of a wedge 60 in such a manner that the expanding mandrels 52 become narrower in the same direction, towards the right in FIG. 1, as the expanding mandrels 32. A ram 62, which can be actuated by a piston-cylinder unit 64 supported on the upright 48, is provided for the actuation of the wedge 60 of each of the expanding mandrels 52. In contrast to the segmental bars 36, which are mounted on the base of the associated supporting member 34, the segmental bars 56 are mounted on a head 66 of the associated supporting member 54.

Ribs 68, each of which adjoins one of the four segmental bars 56, extend from the base of each supporting member 54 to within the vicinity of its head 66. The segmental bars 56 each have a cross-section approximately in the form of a quarter of a circle and have a main portion 70 which extends from the base of the associated expanding mandrel 52 over the greater part of its length and on which an auxiliary portion 72 extends towards the head 66. In their position of rest, the segmental bars 56 form a frustum of a pyramid with their main portions 70, onto which frustum the body 2 can easily be pushed in its oval conically widened form c. Whereas the main portions 70 diverge away from the head 66 already in the state of rest of the segmental bars 56, the auxiliary portions 72 are so formed that they diverge slightly towards the head 66 in the state of rest.

After each rotation of the two rotary tables 31 and 51, one of the expanding mandrels 32 is in alignment with the longitudinal conveyor 20 so that a body 2 of oval cylindrical shape b can be pushed onto it. Conveyor means of conventional construction may be provided for the pushing on, for example dogs which are disposed on the longitudinal conveyor 20 itself, or separate conveyor means of the kind such as is described hereinafter for the transfer of the bodies 2 from one of the expanding mandrels 32 to one of the expanding mandrels 52. The station in which one body 2 at a time is pushed onto one of the expanding mandrels 32 is designated by S1 in FIG. 1.

After the rotary table 31 has been turned through 45°, the same expanding mandrel 32 arrives in a station S2 in which its wedge 40 is pushed, by the ram 42, into the space between the segmental bars 36 so that these are spread apart and widen the body 2 oval conically in the manner described. Then the ram 42 is pulled back, towards the right in FIG. 1, and consequently the segmental bars 36 are restored to the position of rest by the spring 38, while the wedge 40 is urged back axially, likewise towards the right in FIG. 1.

After the withdrawal of the ram 42, the rotary table 31 is turned on stepwise so that the said expanding mandrel 32 together with oval conically widened body 2 passes via stations S2, S3 and S4, into a station S5 which is situated diametrically opposite the station S1. There the expanding mandrel 32 is situated axially opposite one of the expanding mandrels 52 secured to the rotary table 51, with slight spacing therefrom. This second expanding mandrel 52 is in a station S6.

In order to displace the said body 2 from the first expanding mandrel 2 onto the second expanding mandrel 52, that is to say out of the station S5 into the station S6, a pair of transfer conveyors 74 is provided which are disposed diametrically opposite one another with respect to the expanding mandrels 32 and 52 standing in the stations S5 and S6 respectively and which are each displaceable backwards and forwards on a pair of guide bars 76 parallel to the axes B and C. Guided on each transfer conveyor 74 are transverse bars 78 which are displaceable at right angles to the guide bars 76 and carry yokes 80. Secured to each yoke 80 are suction cups 82 which are connected to a suction pump and can be applied against the body 2 to be displaced in order to entrain this out of the station S5 into the station S6 on a movement of the transfer conveyor 74.

The body 2, widened oval-conically and now pushed onto an expanding mandrel 52, passes, on the next step of the rotary table 51, into a station S7 in which the expanding mandrel 52 .s expanded by the action of the ram 62 as a result of which the body 2 is given its mainly frustopyramidal shape and its prismatic shape d in the marginal region 8.

Associated with each of the expanding mandrels 52 is a pair of supports 84 which are secured to the rotary table 51 and on each of which a locking bolt 86 is pivotally mounted. The pair of bolts 86, which is thus associated with each of the expanding mandrels 52, is held together by an annular spring 88. Formed on the wedge 60 of each of the expanding mandrels 52 is a rear flange 90 behind which the associated bolts 86 engage when the ram 62 has urged the wedge 60 into the space between the associated segmental bars 56 in order to spread these apart. In this manner, the segmental bars 56 are locked in their expanded position so that they do not return to their position of rest when the ram 62 is withdrawn and the rotary table 51 is turned on further.

Consequently, each of the expanding mandrels 52 remains expanded on the way from the station S7 into a next station S8. In the station S8, a stamping tool 94 is disposed on a stationary side wall 92 and impresses the recesses 10 described, in the broad sides of each body 2 entering this station. Then the rotary table 51 is turned through a further 45° so that the said expanding mandrel 52 enters a station S9; there the wedge 60 is unlocked so that the segmental bars 56 return to their position of rest.

Finally, the said expanding mandrel 52 arrives, with the now finished body 2, in a station S10 where the body is removed from the said expanding mandrel 52 by means of a device which may be similar to the transfer conveyor 74, and is deposited on a further longitudinal conveyor 96.

The working cycle described is repeated after each rotation of the rotary tables 31 and 51 through 45° so that in the course of a complete revolution through 360° eight can bodies 2 are finished.

I claim:

1. A method of producing frustopyramidal can bodies from welded can bodies of a cylindrical shape comprising:

forming a welded can body of cylindrical shape oval-conically over its whole length in a first forming operation which expands the body at one end and then relaxing the body again and then forming the oval-conical can body in a second forming operation so that it acquires a frustopyramidal shape with a polygon-like, particularly rectangle-like, cross-sectional shape over its whole length.

2. A method according to claim 1, characterized in that the bodies (2) are pressed flat in a preparatory operation before the first forming operation, as a result of which they acquire an oval cylindrical shape.

3. A method according to claim 2, characterized in that a longitudinal seam extends between the two ends of each can body;

while the bodies are being pressed flat, their longitudinal seam is situated in one of two zones of greatest curvature disposed diametrically opposite one another and each zone of greatest curvature is converted into one of a pair of narrower sides of the finished body by the following shaping.

4. A method according to claim 1, characterized in that during the second forming operation, the bodies (2) are widened over the predominant portion of their length so that they assume a frustopyramidal shape becoming narrower from their larger end and are at least resiliently distended, preferably permanently slightly widened in a marginal region (8) adjoining their smaller end so that their former frustoconical shape at least approaches prismatic shape.

5. An apparatus for producing a frusto-pyramidal can body from a generally cylindrical body, said apparatus comprising:

first forming means having a first mandrel for receiving said generally cylindrical body with said body generally overlying and circumscribing the first mandrel, said first mandrel being expandable and having a non-expanded state to receive said generally cylindrical body and an expanded state in which said generally cylindrical body is formed into an oval-conical shape;

second forming means with a second mandrel for receiving said oval-conical body with the oval-conical body generally overlying and circumscribing the second mandrel, the second mandrel also being expandable and having a non-expanded state to receive the oval-conical body and an expanded state in which the oval-conical body is formed into a generally frusto-pyramidal shape, and transfer means for moving the body in the oval-conical shape from the first forming means to the second forming means for forming the body into the frusto-pyramidal shape.

6. The apparatus according to claim 1 further including a longitudinal conveyor, characterized by two lateral conveyor belts, one of said two lateral conveyor belts converging in the direction of movement of the longitudinal conveyor towards the central plane of the longitudinal conveyor to press the circular cylindrical bodies into an oval-cylindrical shape before the bodies are received by the first mandrel.

7. The apparatus according to claim 5, further including a first transverse conveyor which is movable step-by-step and carries at least one first expanding mandrel, associated with the first transverse conveyor is a second transverse conveyor which is likewise movable step-by-step and carries at least one second expanding mandrel, and the second expanding mandrel can be expanded in a pyramidal shape.

8. An apparatus according to claim 6, characterized in that the two transverse conveyors are disposed opposite one another in such a manner that, in a transfer station, a first expanding mandrel is in alignment with a second expanding mandrel, these two mandrels become narrower in the same direction, in the expanded state, and said transfer means include a transfer conveyor disposed between the two transverse conveyors to transfer one body from each first expanding mandrel to the second expanding mandrel in alignment therewith.

9. An apparatus according to claim 8, characterized in that the two transverse conveyors (30,50) each comprise a rotary table (31 and 51 respectively) with a plurality of expanding mandrels (32 and 52 respectively) and the axes (B,C) of the two rotary tables (31,51) are arranged parallel to the longitudinal conveyor (20) with spacing from one another.

10. An apparatus according to claim 9, characterized in that the two transverse conveyors (30,50) each comprise an upright (28 or 48) on which the associated rotary table (31 or 51) is mounted with its expanding mandrels (32 or 52) remote from the upright (28 or 48) and at least one ram (42 or 62) is supported on each upright (28,48) for the actuation of the expanding mandrels (32 or 52) disposed on the associated rotary table (31 or or 51).

11. An apparatus according to claim 6, characterized in that, in the expanded state, each of the second expanding mandrels (52) comprises a main portion (70) in the form of a pyramid and an auxiliary portion (72) in the form of a prism.

12. An apparatus according to claim 6, characterized in that, each of the second expanding mandrels (52) can be locked in its expanded position so that it is able to hold each body (2) which has been widened into a substantially frusto-pyramidal shape, gripped for a stamping treatment.

13. An apparatus according to claim 12, characterized in that a stamping tool (94) is associated with the second transverse conveyor (50) to impress recesses (10) in opposite sides of the bodies.

14. A method for producing a frusto-pyramidal can body from a generally cylindrical can body, said method comprising the steps of:

receiving the generally cylindrical body on a first expandable mandrel so that the body generally overlies and circumscribes the first mandrel;

expanding the first mandrel to form the generally cylindrical body into an oval-conical shape;

transferring the oval-conical body from the first mandrel to a second expandable mandrel so that the oval-conical body generally overlies and circumscribes the second mandrel, and expanding the second mandrel to form the oval-conical body into a frusto-pyramidal shape.

15. The method of claim 14 further including the step of slightly flattening the generally cylindrical body before it is received by the first mandrel.

16. The method of claim 14 further including the steps of:

locking the second mandrel in its expanded position to grip the frusto-pyramidal body, and stamping recesses into opposite sides of the frusto-pyramidal body.

* * * * *

UNITED STATES PATENT AND TRADEMARK OFFICE

CERTIFICATE OF CORRECTION

PATENT NO. : 4,901,557

DATED : February 20, 1990

INVENTOR(S) : Schmidt

It is certified that error appears in the above-identified patent and that said Letters Patent is hereby corrected as shown below:

Title page:

In the Foreign Application Priority Data, delete "Jul. 7, 1988" and substitute--Jul. 7, 1987--.

Signed and Sealed this

Twenty-seventh Day of November, 1990

*Attest:*

HARRY F. MANBECK, JR.

*Attesting Officer*

*Commissioner of Patents and Trademarks*